US011453936B2

(12) United States Patent
Kaneko et al.

(10) Patent No.: US 11,453,936 B2
(45) Date of Patent: Sep. 27, 2022

(54) FERRITIC STAINLESS STEEL WITH EXCELLENT RIDGING RESISTANCE

(71) Applicant: NIPPON STEEL STAINLESS STEEL CORPORATION, Tokyo (JP)

(72) Inventors: Shigeru Kaneko, Tokyo (JP); Katsuhiro Fuchigami, Tokyo (JP); Yoshiharu Inoue, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 99 days.

(21) Appl. No.: 16/979,465

(22) PCT Filed: Mar. 29, 2019

(86) PCT No.: PCT/JP2019/014272
§ 371 (c)(1),
(2) Date: Sep. 9, 2020

(87) PCT Pub. No.: WO2019/189858
PCT Pub. Date: Oct. 3, 2019

(65) Prior Publication Data

US 2021/0010119 A1 Jan. 14, 2021

(30) Foreign Application Priority Data

Mar. 30, 2018 (JP) ..... JP2018-066923

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/60*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C22C 38/60* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search
CPC ..... C22C 38/001; C22C 38/02; C22C 38/04; C22C 38/06; C22C 38/14; C22C 38/18
See application file for complete search history.

(56) References Cited

U.S. PATENT DOCUMENTS

| | | | |
|---|---|---|---|
| 2003/0015260 | A1 | 1/2003 | Zeze et al. |
| 2004/0154708 | A1 | 8/2004 | Takahashi et al. |

FOREIGN PATENT DOCUMENTS

| | | | |
|---|---|---|---|
| JP | 2001-288542 | A | 10/2001 |
| JP | 2004-2974 | A | 1/2004 |
| JP | 2005-272865 | A | 10/2005 |
| JP | 2008-285717 | A | 11/2008 |
| WO | WO 00/61322 | A1 | 10/2000 |
| WO | WO 03/080885 | A1 | 10/2003 |

OTHER PUBLICATIONS

International Search Report (form PCT/ISA/210), dated Jun. 18, 2019, for corresponding International Application No. PCT/JP2019/014272, with an English translation.

*Primary Examiner* — Adam Krupicka
(74) *Attorney, Agent, or Firm* — Birch, Stewart, Kolasch & Birch, LLP

(57) ABSTRACT

Ferritic stainless steel securing corrosion resistance while being excellent in ridging resistance able to be stably provided, that is, ferritic stainless steel with excellent ridging resistance having a composition comprising, by mass %, C: 0.001 to 0.01%, Si: 0.3% or less, Mn: 0.3% or less, P: 0.04% or less, S: 0.01% or less, Cr: 10 to 21%, Al: 0.01 to 0.2%, Ti: 0.015 to 0.3%, O: 0.0005 to 0.0050%, N: 0.001 to 0.02%, Ca: 0.0015% or less, and Mg: 0.0003% to 0.0030% and having a balance of Fe and impurities, in which steel, when defining complex inclusions including oxides and having a long axis of 1 μm or more as complex inclusions (A) and defining complex inclusions satisfying (Formula 1) to (Formula 3) in the complex inclusions (A) as complex inclusions (B), a number ratio of the number of complex inclusions (B) to the number of complex inclusions (A) satisfies (Formula 4), and among the complex inclusions (B), a number density of complex inclusions having a long axis of 2 μm or more and 15 μm or less is 2/mm$^2$ or more and 20/mm$^2$ or less:

$Al_2O_3/MgO \leq 4$ (Formula 1)

$CaO \leq 20\%$ (Formula 2)

$Al_2O_3+MgO \geq 75\%$ (Formula 3)

Number of complex inclusions (*B*)/Number of complex inclusions (*A*)≥0.70 (Formula 4)

where, in (Formula 1) to (Formula 3), $Al_2O_3$, MgO, and CaO indicate the respective mass % in the oxides.

8 Claims, No Drawings

FERRITIC STAINLESS STEEL WITH EXCELLENT RIDGING RESISTANCE

FIELD

The present invention relates to ferritic stainless steel.

BACKGROUND

Ferritic stainless steel is starting to be broadly used due to its high corrosion resistance and workability, but with high workability, conversely the occurrence of ridging becomes a problem. "Ridging" refers to the continuous ridge-like wrinkles formed on the surface of steel sheet at the time of shaping. Ridging detracts from the aesthetic appeal, requires grinding for removal, and otherwise places a large load on production. To suppress ridging, it is effective to increase the ratio of equiaxed grains at the time of casting, make the columnar crystal size finer, or otherwise refine the solidified structures. The method of proactively utilizing inclusions is well known. Specifically, the method of making Mg—Al-based oxides like spinel ($MgO.Al_2O_3$) or making TiN disperse in the molten steel may be mentioned. The solidified primary crystals of the ferritic stainless steel δ-Fe are close to spinel or TiN in crystal lattice constant, so Mg—Al-based oxides and TiN have the effect of promoting solidification of the steel. As a result, it may be said that formation of equiaxed grains not having specific orientations is promoted and ridging is suppressed. Note that, spinel promotes the formation of not only δ-Fe, but also TiN, so the method of promoting use of the produced TiN to promote the formation of δ-Fe is adopted in many cases.

The art described in PTL 1 is characterized by including Ti in 4 (C+N) to 0.40% and by making the Mg/Al mass ratio in the inclusions 0.55 or more plus making V×N 0.0005 to 0.0015 with the aim of promoting recrystallization by V or N.

The art described in PTL 2 promotes the formation of TiN by practical levels of Ti and N, so Si has to be added. However, Si causes a decrease in the workability, so rather than TiN, Mg-based oxides are utilized as the solidification nuclei of δ-Fe. The "Mg-based inclusions" referred to here are inclusions containing Mg. The concentration is not prescribed.

The art described in PTL 3 is characterized by having $3/mm^2$ or more of Mg-containing oxides with an Mg/Ca ratio of 0.5 or more so as to eliminate the defect of the solidified structures not being refined when the Mg-containing oxides contain Ca.

CITATIONS LIST

Patent Literature

[PTL 1] Japanese Unexamined Patent Publication No. 2008-285717

[PTL 2] Japanese Unexamined Patent Publication No. 2004-002974

[PTL 3] Japanese Unexamined Patent Publication No. 2001-288542

SUMMARY

Technical Problem

In PTL 1, to obtain the effect of promotion of formation of δ-Fe by the Mg—Al-based inclusions, not only should the Mg/Al ratio in the Mg—Al-based inclusions be a certain ratio or more, but also the concentration of CaO must be low. Therefore, with this method, in which the concentration of CaO is not prescribed, if the concentration of CaO of the inclusions becomes high, sometimes the anticipated refinement cannot be obtained and ridging cannot be reduced.

In PTL 2, if the concentration of CaO is high, the effect is not obtained. Further, even if Mg is included, if Al is also simultaneously included and the Mg/Al ratio is low (high $Al_2O_3$ corundum is produced), it is not possible for it to become the nuclei for δ-Fe or TiN. Therefore, sometimes ridging cannot be reduced by refinement.

In PTL 3, even if the Mg/Ca ratio is 0.5 or more, if $Al_2O_3$ is present in the oxides, it does not contribute to the refinement of the solidified structures. For this reason, sometimes ridging cannot be reduced.

The present invention has as its technical challenge to throw light on the factors affecting ridging in ferritic stainless steel and secure corrosion resistance while improving the ridging resistance and has as its object the stable provision of ferritic stainless steel with excellent ridging resistance.

Solution to Problem

The inventors investigated in detail the factors believed to affect the ridging resistance in ferritic stainless steel produced by various methods. As a result, they learned that the state of presence of complex inclusions and the composition and ratio of composition of the oxides contained in the complex inclusions affect the ridging resistance. Note that, in the Description, "complex inclusions" are what is called inclusions. For example, when the oxides are covered by nitrides at their surroundings, the size of the inclusions mean the size of the inclusions including those nitrides.

As the composition of the oxides contained in the inclusions, the inventors found that by the ratio of the $Al_2O_3$ and MgO ($Al_2O_3$/MgO) being 4 or less, CaO being 20% or less, the sum of $Al_2O_3$ and MgO satisfying 75% or more, complex inclusions with a long axis of 2 μm or more being present in the steel in a density of $2/mm^2$ or more, and the number ratio of the inclusions with a long axis of 1 μm or more satisfying the above oxide composition and not satisfying the same being made 0.7 or more, the ridging resistance is improved. The present invention was made based on the above findings and has as its gist the following:

(1) Ferritic stainless steel with excellent ridging resistance having a composition comprising, by mass %, C: 0.001 to 0.010%,
Si: 0.30% or less,
Mn: 0.30% or less,
P: 0.040% or less,
S: 0.0100% or less,
Cr: 10.0 to 21.0%,
Al: 0.010 to 0.200%,
Ti: 0.015 to 0.300%,
O: 0.0005 to 0.0050%,
N: 0.001 to 0.020%,
Ca: 0.0015% or less, and
Mg: 0.0003% to 0.0030% and
having a balance of Fe and impurities, in which steel, when defining complex inclusions including oxides and having a long axis of 1 μm or more as complex inclusions (A) and defining complex inclusions satisfying (Formula 1) to (Formula 3) in the complex inclusions (A) as complex inclusions (B), a number ratio of the number of complex inclusions (B) to the number of complex inclusions (A) satisfies (Formula 4), and among the complex inclusions (B), a number density of complex inclusions having a long axis of 2 μm or more and 15 μm or less is 2/mm$^2$ or more and 20/mm$^2$ or less:

$$Al_2O_3/MgO \leq 4 \quad \text{(Formula 1)}$$

$$CaO \leq 20\% \quad \text{(Formula 2)}$$

$$Al_2O_3+MgO \geq 75\% \quad \text{(Formula 3)}$$

$$\text{Number of complex inclusions } (B)/\text{Number of complex inclusions } (A) \geq 0.70 \quad \text{(Formula 4)}$$

where, in (Formula 1) to (Formula 3), $Al_2O_3$, MgO, and CaO indicate the respective mass % in the oxides.

(2) Ferritic stainless steel with excellent ridging resistance according to (1), further containing, by mass %, one or more of B: 0.0020% or less,
Nb: 0.60% or less,
Mo: 2.0% or less,
Ni: 2.0% or less,
Cu: 2.0% or less,
Sn: 0.50% or less
V: 0.200% or less,
Sb: 0.30% or less,
W: 1.00% or less,
Co: 1.00% or less,
Zr: 0.0050% or less,
REM: 0.0100% or less,
Ta: 0.10% or less, and
Ga: 0.0100% or less.

(3) Ferritic stainless steel with excellent ridging resistance according to (1) or (2), wherein the complex inclusions (A) contain TiN and the chemical composition satisfies (Formula 5):

$$2.44\times[\%\ Ti]\times[\%\ N]\times\{[\%\ Si]+0.05\times([\%\ Al]-[\%\ Mo])-0.01\times[\%\ Cr]+0.35\}\geq 0.0008 \quad \text{(Formula 5)}$$

where, [% Ti], [% N], [% Si], [% Al], [% Mo], and [% Cr] show the mass % of the respective elements in the steel. When not contained, 0 is entered.

(4) Ferritic stainless steel with excellent ridging resistance according to any one of (1) to (3), wherein the chemical composition satisfies (Formula 6):

$$250\times[\%\ C]+2\times[\%\ Si]+[\%\ Mn]+50\times[\%\ P]+50\times[\%\ S]+0.06\times[\%\ Cr]+60\times[\%\ Ti]+54\times[\%\ Nb]+100\times[\%\ N]+13\times[\%\ Cu]\geq 36 \quad \text{(Formula 6)}$$

where, [% C], [% Si], [% Mn], [% P], [% S], [% Cr], [% Ti], [% Nb], [% N], and [% Cu] show the mass % of the respective elements in the steel. When not contained, 0 is entered.

Advantageous Effects of Invention

According to the present invention, it becomes possible to stably provide ferritic stainless steel securing corrosion resistance while being excellent in ridging resistance.

DESCRIPTION OF EMBODIMENTS

Below, the present invention will be explained. Unless otherwise indicated, the "%" relating to the composition means the mass % in the steel. In particular, when no lower limit is defined, the case of non-inclusion (0%) is also included.

Regarding Steel Constituents

C: 0.001 to 0.010%

C forms carbides of Cr to thereby lower the corrosion resistance and remarkably lowers the workability, so the content is made 0.010% or less. However, excessive reduction leads to the decarburizing time to increase in the refining process, so the content is made 0.001% or more. Preferably, the lower limit may be made 0.002% and the upper limit may be made 0.008%. More preferably, the lower limit may be made 0.004% and the upper limit may be made 0.007%.

Si: 0.30% or Less

Si is an element contributing to deoxidizing, but lowers the workability. With Al, which is a more powerful element than even Si, oxygen can be sufficiently removed, so Si does not have to be added, but an amount used as a preliminary deoxidizer before addition of Al may be added without problem. If adding it, to obtain its effects, 0.01% or more may be included. Preferably, the content may be made 0.05% or more. On the other hand, to prevent a drop in the workability, the content is made 0.30% or less. Preferably, the content may be made 0.25% or less.

Mn: 0.30% or Less

Mn, like Si, is an element contributing to deoxidizing, but lowers the workability. With Al, which is a more powerful element than even Mn, oxygen can be sufficiently removed, so Mn does not have to be added, but an amount used as a preliminary deoxidizer before addition of Al may be added without problem. If adding it, to obtain its effects, 0.01% or more may be included. Preferably, the content may be made 0.05% or more. On the other hand, to prevent a drop in the workability, the content is made 0.30% or less. Preferably, the content may be made 0.25% or less.

P: 0.040% or Less

P causes the toughness and hot workability and corrosion resistance to fall and is otherwise harmful to stainless steel, so the smaller the content the better. The content may be made 0.040% or less. However, excessive reduction places a high load at the time of refining or requires the use of expensive raw materials, so in actual operations, 0.005% or more may be contained.

S: 0.0100% or Less

S causes the toughness and hot workability and corrosion resistance to fall and is otherwise harmful to stainless steel, so the smaller the content the better. The upper limit may be made 0.0100% or less. However, excessive reduction places a high load at the time of refining or requires the use of expensive raw materials, so in actual operations, 0.0002% or more may be contained.

Cr: 10.0 to 21.0%

Cr is an important element giving stainless steel its corrosion resistance. 10.0% or more should be contained. Preferably, the content may be made 12.5% or more, more preferably 15.0% or more. On the other hand, a large amount of content invites a drop in the workability, so the content should be made 21.0% or less. Preferably the content may be made 19.5% or less, more preferably may be made 18.5% or less.

Al: 0.010 to 0.200%

Al is an element required for deoxidizing steel. It is also an element necessary for desulfurization to improve the corrosion resistance. For this reason, the lower limit is made 0.010%. Preferably, the content may be made 0.120% or more, more preferably 0.130% or more. Excessive addition causes the workability to fall, so the content may be made 0.200% or less. Preferably, the content may be made 0.160% or less, more preferably may be made 0.120% or less.

Ti: 0.015 to 0.300%

Ti is an important element not only for securing corrosion resistance through the action of stabilizing C and N, but also for promoting the formation of equiaxed grains and improving the ridging resistance by TiN. For stabilizing the C and N, 0.015% or more is necessary. Preferably, the content is 0.030% or more, more preferably 0.05% or more, still more preferably 0.09% or more. However, if excessively adding it, TiN is remarkably formed and invites nozzle clogging at the time of production and surface defects in the products, so the content may be made 0.300% or less, preferably may be made 0.250% or less, more preferably may be made 0.210% or less.

O: 0.0005 to 0.0050%

O is an essential element for forming the oxides required for promoting formation of TiN. The lower limit may be made 0.0005%, preferably 0.0010%, more preferably 0.0020%. If present in more than 0.0050%, not only are MnO or $Cr_2O_3$ or $SiO_2$ or such lower oxides formed and lower the cleanliness, but contact and bonding with oxides promoting the formation of TiN in the molten steel cause their properties to end up changing, so the content may be made 0.0050% or less, preferably 0.0045% or less, more preferably 0.0040% or less.

N: 0.001 to 0.020%

N causes the workability to fall and bonds with Cr to cause the corrosion resistance to fall, so the less the better. The content may be made 0.020% or less. Preferably, it may be made 0.018% or less, more preferably 0.015% or less. On the other hand, excessive reduction places a large load on the refining step, so 0.001% or more may be contained. Further, it is an element forming TiN. If 0.008% or more, there is a possibility of formation of TiN. The preferable range when not causing the formation of TiN may be made 0.001% or more and less than 0.008%. The preferable range when causing the formation of TiN may be 0.008% or more and 0.015% or less.

Ca: 0.0015% or Less

Ca may be contained in 0.0015% or less since if present in over 0.0015%, the concentration in the oxides for promoting formation of TiN rises and that ability is lost. More preferably, the content may be made 0.0010% or less, more preferably 0.0005% or less.

The lower limit is not particularly set, but Ca is a main constituent of slag. Some entrainment is unavoidable. Further, complete removal is difficult. Excessive reduction results in a high load at the time of refining, so in actual operation, 0.0001% or more may be contained.

Mg: 0.0003 to 0.0030%

Mg is an essential element for forming the oxides required for promoting formation of TiN. 0.0003% or more may be contained. Preferably, 0.0006% or more, more preferably 0.0009% or more may be contained. However, excessive addition invites a drop in corrosion resistance, so the content may be made 0.0030% or less, preferably 0.0027% or less, more preferably 0.0024% or less.

The balance of the steel composition consists of Fe and impurities. Here, "impurities" mean a composition entering due to various factors in the production process such as the ore, scrap, and other raw materials when industrially producing steel where are of an allowable extent not having a detrimental effect on the present invention.

Further, the ferritic stainless steel of the present embodiment may also contain, in place of Fe, by mass %, B: 0.0020% or less, Nb: 0.60% or less, and, further, one or more of, Mo: 2.0% or less, Ni: 2.0% or less, Cu: 2.0% or less, and Sn: 0.50% or less.

B: 0.0020% or Less

B is an element increasing the strength of the grain boundaries and contributes to the improvement of the workability. If contained, to obtain that effect, it may be included in 0.0001% or more, more preferably the content is made 0.0005% or more. On the other hand, excessive addition conversely invites a drop in the workability due to the drop in elongation, so the content may be made 0.0020% or less, preferably may be made 0.0010% or less.

Nb: 0.60% or Less

Nb has the action of improving the shapeability and corrosion resistance. If contained, to obtain that effect, 0.10% or more may be included, preferably the content is made 0.25% or more. On the other hand, if adding over 0.60%, recrystallization becomes difficult and the structures become coarser, so the content may be made 0.60% or less, preferably may be made 0.50% or less.

Mo: 2.0% or Less

Mo, upon addition, has the action of further improving the high corrosion resistance of stainless steel. If contained, to obtain that effect, 0.1% or more may be included. Preferably the content is made 0.5% or more. On the other hand, the element is extremely expensive, so even if adding more than 2.0%, an effect commensurate with the increase in the alloy cost cannot be obtained. Not only that, it forms brittle sigma phases at a high Cr and invites embrittlement and a fall in corrosion resistance, so the content may be made 2.0% or less, preferably the content may be made 1.5% or less.

Ni: 2.0% or Less

Ni, upon addition, has the action of further raising the high corrosion resistance of stainless steel. If contained, to obtain that effect, 0.1% or more should be contained. Preferably the content is made 0.2% or more. On the other hand, this is an expensive element, so even if over 2.0% is added, no effect commensurate with the increase in the alloy cost is obtained, so the content should be made 2.0% or less, preferably should be made 1.5% or less.

Cu: 2.0% or Less

Cu, upon addition, has the action of further raising the high corrosion resistance of stainless steel. If contained, to obtain that effect, 0.1% or more should be contained. Preferably the content is made 0.5% or more. On the other hand, excessive addition does not improve the performance commensurate with the cost of production, so the content should be made 2.0% or less, preferably should be made 1.5% or less.

Sn: 0.50% or Less

Sn, upon addition, has the action of further raising the high corrosion resistance of stainless steel. If contained, to obtain that effect, 0.01% or more should be contained. Preferably the content is made 0.02% or more. On the other hand, excessive addition leads to a drop in workability, so the content should be made 0.50% or less, preferably should be made 0.30% or less.

Further, the high purity ferritic stainless steel of the present embodiment may also contain, in place of the Fe, by mass %, V: 0.20% or less, Sb: 0.30% or less, W: 1.0% or less, Co: 1.0% or less, Zr: 0.0050% or less, REM: 0.0100% or less, Ta: 0.10% or less, and Ga: 0.01% or less.

V: 0.200% or Less

V, upon addition, has the action of further improving the high corrosion resistance of stainless steel. If contained, to obtain that effect, 0.050% or more may be included. Preferably the content is made 0.100% or more. On the other hand, if contained in a high concentration, a drop in the toughness is invited, so the upper limit is made 0.200%.

Sb: 0.30% or Less

Sb, upon addition, has the action of further improving the high corrosion resistance of stainless steel, so may be included in 0.01% or more. Further, it aids the formation of TiN to make δ-Fe easier to form, so the solidified structures become finer and the ridging resistance is improved. The preferable content for obtaining these effects is 0.10% or less.

W: 1.00% or Less

W, upon addition, has the action of further improving the high corrosion resistance of stainless steel. If contained, to obtain that effect, 0.05% or more may be included. Preferably the content is made 0.25% or more. On the other hand, the element is extremely expensive, so even if excessively adding it, an effect commensurate with the increase in the alloy cost cannot be obtained, therefore the upper limit is made 1.00%.

Co: 1.00% or Less

Co, upon addition, has the action of further improving the high corrosion resistance of stainless steel. If contained, to obtain that effect, 0.10% or more may be included. Preferably the content is made 0.25% or more. On the other hand, the element is extremely expensive, so even if excessively adding it, an effect commensurate with the increase in the alloy cost cannot be obtained, therefore the upper limit is made 1.00%.

Zr: 0.0050% or Less

Zr has the effect of fixing S, so can improve the corrosion resistance, therefore may be included in 0.0005% or more. However, it is extremely high in affinity with S, so if excessively adding it, it forms coarse sulfides in the molten steel and conversely the corrosion resistance falls. For this reason, the upper limit is made 0.0050%.

REMs: 0.0100% or Less

REMs (rare earth metals) are high in affinity with S and act as elements fixing S. An effect of inhibiting formation of CaS can be expected, so they may be included in 0.0005% or more. However, excessive inclusion of REMs becomes a cause of nozzle clogging at the time of casting. Further, coarse sulfides are formed and conversely deterioration of the corrosion resistance is invited. For this reason, the upper limit is made 0.0100%. Note that "REMs" indicates a total of 17 elements comprised of Sc, Y, and the lanthanoids. The content of the REMs means the total content of these 17 elements.

Ta: 0.10% or Less

Ta has the effect of fixing S, so can improve the corrosion resistance, therefore may be included in 0.01% or more. However, excessive addition invites a drop in toughness, so the upper limit is made 0.10%.

Ga: 0.0100% or Less

Ga has the effect of raising the corrosion resistance, therefore can be included in an amount of 0.0100% or less in accordance with need. The lower limit of Ga is not particularly set, but 0.0001% or more where a stable effect is obtained is desirably contained.

Regarding Composite Inclusions

In this Description, complex inclusions including oxides and having a long axis of 1 μm or more are defined as complex inclusions (A) and complex inclusions having oxides satisfying (Formula 1) to (Formula 3) by mass % in the complex inclusions (A) are defined as complex inclusions (B). However, in (Formula 1) to (Formula 3), $Al_2O_3$, MgO, and CaO show the respective mass % in the oxides.

Regarding Oxide Composition $Al_2O_3/MgO \leq 4.0$ $Al_2O_3/MgO=4.0$ substantially corresponds to a pure spinel composition. $Al_2O_3$—MgO-based inclusions having compositions in the range of pure spinel to pure MgO effectively act to promote formation of δ-Fe. The closer to pure MgO, the better the δ-Fe forming ability, so $Al_2O_3/MgO$ is made ≤4.0. Preferably, $Al_2O_3/MgO \leq 1.0$. Further, as to the conditions under which TiN is formed, TiN is easily formed if the composition is in the above range.

$$Al_2O_3/MgO \leq 4.0 \quad \text{(Formula 1)}$$

Concentration of CaO in Oxides≤20%

If the concentration of CaO in the oxides is high, the melting point falls and δ-Fe does not become a solid at the temperature for solidification or the lattice matching with δ-Fe and TiN becomes poor. For this reason, the solidification nuclei of δ-Fe and TiN are eliminated and refinement of the solidified structures cannot be expected. The lower the concentration of CaO, the more the formation of δ-Fe and TiN is promoted, so CaO is made ≤20%. Preferably, CaO≤15%, more preferably CaO≤10%.

$$CaO \leq 20\% \quad \text{(Formula 2)}$$

$Al_2O_3+MgO \geq 75\%$

It is important that the oxides be good in lattice matching with δ-Fe or TiN. If not only CaO, but also constituents other than $Al_2O_3$ or MgO are large in amount, the melting point becomes lower or the crystal structure ends up changing. For this reason, the sum of $Al_2O_3$ and MgO is made to become 75% or more, preferably 85% or more.

$$Al_2O_3+MgO \geq 75\% \quad \text{(Formula 3)}$$

Number of Complex Inclusions (B)/Number of Complex Inclusions (A)≥0.70

In complex inclusions including oxides and having a long axis of 1 μm or more, complex inclusions including oxides not satisfying the conditions of (Formula 1) to (Formula 3) obstruct obtaining the effect of complex inclusions (B) including oxides satisfying the conditions of (Formula 1) to (Formula 3) becoming nuclei for δ-Fe or TiN. In particular, if the number ratio of the number of complex inclusions (B) to the number of complex inclusions (A) including oxides not satisfying the conditions of the (Formula 1) to (Formula 3) is less than 0.7 (70%), it becomes harder for the complex inclusions (B) to act as nuclei for δ-Fe or TiN. For this reason, the number ratio of the number of complex inclusions (B) to the number of complex inclusions (A) is made 0.70 (70%) or more.

$$\text{Number of complex inclusions } (B)/\text{Number of complex inclusions } (A) \geq 0.70 \quad \text{(Formula 4)}$$

Number Density of Complex Inclusions (B) with a Long Axis of 2.0 to 15.0 μm: 2 to 20/mm$^2$ Among the complex inclusions (B), ones having a size with a maximum size of 2 μm or more easily form solidification nuclei of δ-Fe. However, if more than 15 μm large, they become causes of surface defects, so the size is made 15.0 μm or less. Preferably, it is 10.5 μm or less, more preferably 5.0 μm or less. Note that, here, the "complex inclusions (B)" are particles in the steel containing oxides satisfying the conditions of (Formula 1) to (Formula 3) and may also be of a form with accompanying TiN around the oxides. Making 2/mm$^2$ or more complex inclusions (B) with a long axis of 2.0 to 15.0 μm disperse in the steel makes them effectively work as solidification nuclei, so the ratio of equiaxed grains becomes higher and the ridging resistance is improved. On the other hand, the $Al_2O_3$—MgO-based oxides contained in the complex inclusions (B) with a long axis of 2.0 to 15.0 μm have high melting points composition wise and are hard. If present in a large amount, they easily become causes of surface defects and cracking. For this reason, the upper limit is made 20/mm$^2$.

$$2.44\times[\%\ Ti]\times[\%\ N]\times\{[\%\ Si]+0.05\times([\%\ Al]-[\%\ Mo])-0.01\times[\%\ Cr]+0.35\}\geq 0.0008$$

If the composition in the steel satisfies the conditions of (Formula 5), TiN easily forms around the oxides in the molten steel. It was confirmed that even if the oxides are small, due to the TiN, the size is secured and the oxides can become solidification nuclei. Even if these conditions are not satisfied, in steel sheet, sometimes TiN is present around the oxides, but mostly it precipitates after solidification. The contribution to refinement is considered limited.

$$2.44\times[\%\ Ti]\times[\%\ N]\times\{[\%\ Si]+0.05\times([\%\ Al]-[\%\ Mo])-0.01\times[\%\ Cr]+0.35\}\geq 0.0008 \quad \text{(Formula 5)}$$

where, [% Ti], [% N], [% Si], [% Al], [% Mo], and [% Cr] show the mass % in the steel of the respective elements. When not contained, 0 is entered.

$$250\times[\%\ C]+2\times[\%\ Si]+[\%\ Mn]+50\times[\%\ P]+50\times[\%\ S]+0.06\times[\%\ Cr]+60\times[\%\ Ti]+54\times[\%\ Nb]+100\times[\%\ N]+13\times[\%\ Cu]\geq 36$$

If the composition in the steel satisfies the conditions of (Formula 6), δ-Fe easily forms starting from complex inclusions (B) as nuclei. Further, it was confirmed that once produced, it was difficult to redissolve. Therefore, by satisfying (Formula 6), the frequency of formation of δ-Fe becomes higher and overall solidification is completed without growth of the nuclei greatly proceeding, so not only does the ratio of equiaxed grains become higher, but also the structures more easily become refined. For this reason, the ridging resistance is further improved.

$$250\times[\%\ C]+2\times[\%\ Si]+[\%\ Mn]+50\times[\%\ P]+50\times[\%\ S]+0.06\times[\%\ Cr]+60\times[\%\ Ti]+54\times[\%\ Nb]+100\times[\%\ N]+13\times[\%\ Cu]\geq 36 \quad \text{(Formula 6)}$$

where, [% C], [% Si], [% Mn], [% P], [% S], [% Cr], [% Ti], [% Nb], [% N], and [% Cu] show the mass % in the steel of the respective elements. When not contained, 0 is entered.

Below, the method of measurement of the inclusions will be explained. A cross-section of the cast slab or steel sheet is observed and 100 or more inclusions including oxides and having a long axis of 1.0 μm or more are randomly selected. These are used as the population. The inclusions contained in the population are analyzed by SEM-EDS and the sizes and types and numbers of the inclusions are identified. At that time, the observed area is also recorded. Further, in the case of steel sheet, the cross-section vertical to the rolling direction is observed and the above operation performed. In the case of steel sheet, the inclusions at the time of observation are ones after deformation due to the effects of rolling etc. At the long axis in the cross-section parallel to the rolling direction, often evaluation is not possible. On the other hand, there is almost no deformation in the sheet width direction, so the long axis of inclusions observed in a vertical cross-section is believed to be substantially the same as the size of inclusions at the time of solidification. For this reason, in the case of steel sheet, the cross-section vertical to the rolling direction is observed.

Next, the method for producing the ferritic stainless steel of the present embodiment will be explained. In smelting steel adjusted to a predetermined composition in the above way, at the initial period of secondary refining, Al is used for desulfurization. At that stage, the concentration of 0 in the molten steel is made 0.0060% or less. Due to this, it is possible to stably raise the amounts and ratios of complex inclusions satisfying $Al_2O_3+MgO\geq 75\%$ shown in (Formula 3). At that time, it is also possible to preliminarily deoxidize the steel by Si or Mn before Al. The inclusions formed by entrainment in the molten steel by primary refining are high in concentration of CaO, so are made to float up and removed sufficiently, then Ti or Mg is added. The order of addition of Ti and Mg is not an issue. Further, the mode of addition of Mg is not particularly limited, but metal Mg or Ni—Mg or other alloy form may be mentioned. In addition, the method of indirect addition by adding MgO to the refining slag and returning the Mg from the slag to the molten steel may be used. Regardless of the mode of addition of Mg, the active amount of MgO in the slag should be high. It is not determined unambiguously in relation to other constituents, but generally should be about 0.7 based on pure solid MgO. Due to this, it is possible to stably raise the amounts and ratios of complex inclusions satisfying $Al_2O_3/MgO\leq 4$ shown in (Formula 1) and $CaO\leq 20\%$ shown in (Formula 2). At that time, it is difficult to measure the active amount of MgO in the slag during operations, so it may be calculated by measuring the composition of the slag and using thermodynamic data and commercial thermodynamic calculation software.

By making the active amount of MgO contained in the slag 0.7 or more based on pure solid MgO and by making the composition of the steel the above-mentioned predetermined composition, it is possible to increase the amounts and number ratio of the complex inclusions satisfying $Al_2O_3/MgO\leq 4$ shown in (Formula 1) and $CaO\leq 20\%$ shown in (Formula 2). Measuring the active amount of MgO at the time of operation is difficult, so it is sufficient to measure the composition of the slag and refer the results against thermodynamic data or calculate the amount using general use thermodynamic calculation software.

By deoxidizing the steel by Al at the initial stage of the secondary refining to lower the 0 in the molten steel at that stage to 0.0060% or less and finally make it 0.0050% or less, the concentration of lower oxides does not become that high and it is possible to raise the amount of inclusions and the number ratio so that $Al_2O_3+MgO\geq 75\%$ shown in (Formula 3) is satisfied.

Molten steel with compositions or amounts of inclusions adjusted is cast by continuous casting to obtain the ferritic stainless steel of the present invention. This is then hot rolled or cold rolled etc. for use for various products. However, the method for production of the present invention is not limited to this. It can be suitably set within a range where the stainless steel according to the present invention is obtained.

Examples

In the secondary refining, Al etc. were used to deoxidize the steel and adjust the slag, metal Mg and Mg alloy, Ti alloy, etc. were added to control the composition and the amounts and compositions of the inclusions while smelting, and the molten steel having the composition shown in Table 1 was cast by a continuous casting machine and hot rolled. For the MgO in the slag at the time of secondary refining, the active amount based on the pure MgO solid was shown together in Table 1. Further, the hot rolled steel sheet was annealed and pickled then was cold rolled and annealed and pickled to thereby produce 1.0 mm thick cold rolled sheet which was then used for measurement of the inclusions and measurement of the ridging height. Note that, as explained later, in some examples, the casting was stopped in the middle.

For the composition of the inclusions, a cross-section of the cold rolled sheet vertical to the rolling direction was made the observed surface. 100 inclusions including oxides and having a long axis of 1.0 μm or more were randomly selected and the long axis and the composition of oxide parts were measured by SEM-EDS. At that time, the observed area was recorded and the number density was calculated. The ridging height was measured by obtaining a No. 5 tensile test piece based on JIS Z2241 and applying 15% tensile strain in the rolling direction. After tension, a relief profile was obtained by a roughness meter for the center in the parallel part of the test piece. From the relief profile, the maximum value of the length in the sheet thickness direction between top points of adjoining projecting parts and recessed parts (height of relief) was defined as the ridging height. The ridging height was used to rank the ridging resistance as follows. A ridging height of less than 10 μm was denoted as an excellent AA, A, and B (passing).

AA: Less Than 3 μm, A: Less Than 5 μm, B: Less Than 10 μm, C: Less Than 20 μm, D: 20 μm or More As shown in Table 2, the Test Materials B1 to B21 had a steel composition and amounts of complex inclusions and number ratios satisfying the present invention. The corrosion resistances were secured while the ridging resistances were also excellent. The active amounts of MgO in the slag at the time of the secondary refining were 0.7 or more.

The Test Material b1 had a low concentration of O. For this reason, in the amount of complex inclusions (B), the amount of complex inclusions with a long axis of 2 to 15 μm becoming nuclei for equiaxed grains did not satisfy the number density, so large ridging occurred. Further, the concentration of N was high and the workability was also poor.

The Test Material b2 had a low concentration of Al and a high concentration of O. For this reason, the concentration of lower oxides became higher and there were many inclusions not satisfying (Formula 1) or (Formula 3). (Formula 4) could not be satisfied. For this reason, ridging occurred. Further, the desulfurization was also insufficient and the concentration of S was high, so corrosion also occurred due to sulfide-based inclusions.

The Test Material b3 had a high concentration of Ca, had many inclusions not satisfying (Formula 2), and did not satisfy (Formula 4). Further, in the complex inclusions (B), the amount of complex inclusions with a long axis of 2 to 15 μm becoming nuclei for equiaxed grains also did not satisfy the number density. For this reason, large ridging occurred. Further, the concentration of Si was high and the workability was also poor.

The Test Material b4 had a low active amount of MgO in the slag, so the concentration of Mg was low. There were many inclusions not satisfying (Formula 1) or (Formula 3). (Formula 4) could not be satisfied. Further, in the complex inclusions (B), the amount of complex inclusions with a long axis of 2 to 15 μm becoming nuclei for equiaxed grains also did not satisfy the number density. For this reason, large ridging occurred. Further, the concentration of Mn and concentration of Cr were high and the workabilities were also poor.

The Test Material b5 had a high concentration of Ti and was formed with a large amount of TiN before casting, so nozzle clogging occurred and casting was not possible (casting was suspended in the middle of the process).

The Test Material b6 had a high concentration of Al, concentration of Ca, and concentration of Mg and also had a somewhat high concentration of O, so a large amount of inclusions was formed and the density of number of complex inclusions (B) was extremely large. However, there were also many inclusions not satisfying (Formula 1). (Formula 4) was not satisfied, so ridging occurred. Further, numerous surface defects were caused due to the large amount of $Al_2O_3$—MgO-based inclusions.

TABLE 1

| Steel | Chemical composition (mass %) | | | | | | | | | | | |
|---|---|---|---|---|---|---|---|---|---|---|---|---|
| no. | C | Si | Mn | P | S | Cr | Al | Ti | 0 | N | Ca | Mg |
| A1 | 0.009 | 0.18 | 0.24 | 0.025 | 0.0066 | 18.1 | 0.12 | 0.20 | 0.0014 | 0.016 | 0.0010 | 0.0029 |
| A2 | 0.006 | 0.28 | 0.22 | 0.031 | 0.0028 | 14.0 | 0.13 | 0.21 | 0.0007 | 0.011 | 0.0007 | 0.0024 |
| A3 | 0.007 | 0.02 | 0.27 | 0.040 | 0.0008 | 13.8 | 0.12 | 0.28 | 0.0035 | 0.017 | 0.0014 | 0.0004 |
| A4 | 0.007 | 0.13 | 0.20 | 0.038 | 0.0069 | 12.7 | 0.15 | 0.12 | 0.0027 | 0.007 | 0.0006 | 0.0013 |
| A5 | 0.002 | 0.29 | 0.07 | 0.018 | 0.0080 | 15.3 | 0.12 | 0.13 | 0.0020 | 0.018 | 0.0001 | 0.0017 |
| A6 | 0.001 | 0.08 | 0.27 | 0.016 | 0.0051 | 10.2 | 0.06 | 0.06 | 0.0046 | 0.009 | 0.0006 | 0.0028 |
| A7 | 0.005 | 0.29 | 0.00 | 0.036 | 0.0002 | 20.8 | 0.16 | 0.05 | 0.0029 | 0.007 | 0.0013 | 0.0013 |
| A8 | 0.006 | 0.11 | 0.13 | 0.020 | 0.0067 | 18.2 | 0.02 | 0.20 | 0.0041 | 0.006 | 0.0005 | 0.0024 |
| A9 | 0.001 | 0.17 | 0.26 | 0.015 | 0.0012 | 16.6 | 0.19 | 0.07 | 0.0013 | 0.013 | 0.0007 | 0.0017 |
| A10 | 0.002 | 0.10 | 0.23 | 0.038 | 0.0096 | 15.8 | 0.12 | 0.02 | 0.0031 | 0.006 | 0.0006 | 0.0023 |
| A11 | 0.007 | 0.21 | 0.08 | 0.032 | 0.0095 | 15.0 | 0.04 | 0.29 | 0.0038 | 0.014 | 0.0007 | 0.0012 |
| A12 | 0.003 | 0.20 | 0.28 | 0.030 | 0.0024 | 14.2 | 0.02 | 0.11 | 0.0008 | 0.008 | 0.0009 | 0.0005 |
| A13 | 0.005 | 0.18 | 0.09 | 0.038 | 0.0081 | 12.0 | 0.12 | 0.09 | 0.0047 | 0.010 | 0.0006 | 0.0016 |
| A14 | 0.004 | 0.08 | 0.10 | 0.020 | 0.0052 | 10.5 | 0.16 | 0.24 | 0.0029 | 0.019 | 0.0008 | 0.0029 |
| A15 | 0.004 | 0.13 | 0.07 | 0.017 | 0.0037 | 18.1 | 0.09 | 0.25 | 0.0022 | 0.007 | 0.0014 | 0.0009 |
| A16 | 0.009 | 0.29 | 0.18 | 0.036 | 0.0002 | 20.7 | 0.05 | 0.07 | 0.0005 | 0.009 | 0.0010 | 0.0004 |
| A17 | 0.007 | 0.08 | 0.11 | 0.022 | 0.0074 | 19.5 | 0.18 | 0.07 | 0.0038 | 0.016 | 0.0009 | 0.0028 |
| A18 | 0.005 | 0.07 | 0.07 | 0.028 | 0.0008 | 17.2 | 0.08 | 0.21 | 0.0021 | 0.012 | 0.0003 | 0.0014 |
| A19 | 0.002 | 0.12 | 0.11 | 0.014 | 0.0012 | 16.1 | 0.04 | 0.18 | 0.0030 | 0.011 | 0.0002 | 0.0006 |
| A20 | 0.008 | 0.28 | 0.21 | 0.027 | 0.0014 | 20.2 | 0.05 | 0.03 | 0.0024 | 0.018 | 0.0004 | 0.0005 |
| A21 | 0.009 | 0.05 | 0.28 | 0.032 | 0.0032 | 16.5 | 0.11 | 0.12 | 0.0009 | 0.010 | 0.0003 | 0.0007 |
| A22 | 0.002 | 0.07 | 0.18 | 0.021 | 0.0066 | 17.0 | 0.18 | 0.02 | 0.0009 | 0.018 | 0.0003 | 0.0016 |
| A23 | 0.007 | 0.20 | 0.08 | 0.035 | 0.0069 | 11.9 | 0.15 | 0.11 | 0.0044 | 0.006 | 0.0001 | 0.0012 |
| A24 | 0.005 | 0.18 | 0.28 | 0.011 | 0.0040 | 10.8 | 0.09 | 0.16 | 0.0046 | 0.012 | 0.0008 | 0.0023 |
| a1 | 0.003 | 0.16 | 0.18 | 0.045 | 0.0063 | 9.7 | 0.208 | 0.16 | 0.0044 | 0.007 | 0.0017 | 0.0035 |
| a2 | 0.007 | 0.03 | 0.33 | 0.038 | 0.0023 | 21.2 | 0.135 | 0.15 | 0.0026 | 0.013 | 0.0007 | 0.0002 |
| a3 | 0.003 | 0.09 | 0.10 | 0.039 | 0.0113 | 11.7 | 0.007 | 0.06 | 0.0068 | 0.010 | 0.0012 | 0.0005 |
| a4 | 0.005 | 0.12 | 0.13 | 0.028 | 0.0014 | 14.7 | 0.223 | 0.13 | 0.0004 | 0.023 | 0.0008 | 0.0023 |
| a5 | 0.015 | 0.17 | 0.28 | 0.039 | 0.0099 | 13.2 | 0.176 | 0.32 | 0.0044 | 0.012 | 0.0006 | 0.0008 |
| a6 | 0.003 | 0.34 | 0.21 | 0.006 | 0.0051 | 15.5 | 0.065 | 0.16 | 0.0033 | 0.009 | 0.0021 | 0.0026 |

TABLE 1-continued

| Steel no. | Chemical composition (mass %) B | Nb | Mo | Ni | Cu | Sn | Other element | F (5) left | F (6) left | Active amount of MgO | Remark |
|---|---|---|---|---|---|---|---|---|---|---|---|
| A1 | | | 1.7 | | | | | 0.00205 | 18 | 0.923 | |
| A2 | 0.0005 | 0.26 | 1.8 | | | | | 0.00221 | 32 | 0.852 | |
| A3 | | | | | 0.2 | 0.27 | | 0.00292 | 25 | 0.709 | |
| A4 | 0.0019 | | | 0.1 | | | | 0.00078 | 13 | 0.739 | |
| A5 | | | 0.7 | | | | | 0.00256 | 12 | 0.838 | |
| A6 | | | | | 1.4 | 0.47 | | 0.00042 | 25 | 0.894 | |
| A7 | | 0.49 | 1.3 | | | 0.35 | | 0.00029 | 34 | 0.843 | |
| A8 | | | 0.3 | 0.6 | | | | 0.00072 | 16 | 0.940 | |
| A9 | 0.0003 | | 0.5 | | | | | 0.00073 | 7 | 0.923 | |
| A10 | 0.0010 | | | 0.4 | 0.9 | | | 0.00008 | 16 | 0.862 | |
| A11 | 0.0005 | 0.24 | 0.9 | | | 0.27 | | 0.00372 | 37 | 0.802 | |
| A12 | 0.0007 | 0.58 | | 1.9 | | | | 0.00090 | 42 | 0.724 | |
| A13 | | | 1.0 | | 1.4 | | | 0.00080 | 29 | 0.894 | |
| A14 | 0.0017 | | | 0.3 | | 0.48 | | 0.00373 | 19 | 0.993 | |
| A15 | 0.0002 | 0.47 | | | | | | 0.00127 | 44 | 0.758 | |
| A16 | 0.0017 | 0.12 | | | 1.4 | 0.03 | | 0.00064 | 35 | 0.706 | |
| A17 | | 0.48 | | | | | | 0.00064 | 35 | 0.869 | |
| A18 | 0.0017 | 0.25 | 1.3 | 0.2 | | 0.45 | | 0.00116 | 31 | 0.756 | |
| A19 | | | 0.3 | | 1.9 | | | 0.00144 | 38 | 0.736 | |
| A20 | | 0.51 | 0.5 | 0.3 | 0.2 | | Co: 0.6%, Ga: 0.006% | 0.00053 | 39 | 0.784 | |
| A21 | 0.0005 | | | | 1.9 | 0.11 | W: 0.7%, Zr: 0.0013% | 0.00070 | 38 | 0.801 | |
| A22 | | | | 1.7 | | 0.38 | REM: 0.005% | 0.00025 | 6 | 0.821 | |
| A23 | | 0.11 | | | 1.6 | 0.24 | V: 0.17%, Sb: 0.18% | 0.00067 | 38 | 0.714 | |
| A24 | | | 1.4 | | | | Ta: 0.009% | 0.00167 | 14 | 0.945 | |
| a1 | | 0.58 | 0.5 | 1.3 | 2.0 | | | 0.00109 | 72 | 0.942 | |
| a2 | | | 1.5 | 0.8 | 0.1 | | | 0.00042 | 16 | 0.418 | |
| a3 | | 0.51 | | 1.3 | | | | 0.00047 | 36 | 0.530 | |
| a4 | 0.0005 | | 0.8 | | 1.4 | 0.25 | | 0.00227 | 32 | 0.637 | |
| a5 | | | 1.7 | | | | | 0.00288 | 27 | 0.563 | |
| a6 | | 0.31 | | | 1.4 | | | 0.00182 | 48 | 0.704 | |

TABLE 2

| | Notation | Steel no. | Number ratio of long axis 1 μm or more composite oxides (A) and composite oxides (B) (Number of B/Number of A) | Number density of long axis 2 to 15 μm composite oxides among long axis 1 μm or more composite oxides (B) (/mm$^2$) | Evaluation of properties: ridging resistance | Remarks |
|---|---|---|---|---|---|---|
| Ex. | B1 | A12 | 0.81 | 3.9 | AA | |
| | B2 | A7 | 0.74 | 2.8 | B | |
| | B3 | A18 | 0.72 | 17.1 | A | |
| | B4 | A17 | 0.85 | 2.2 | B | |
| | B5 | A13 | 0.85 | 19.6 | A | |
| | B6 | A8 | 0.71 | 14.5 | B | |
| | B7 | A6 | 0.94 | 12.3 | B | |
| | B8 | A1 | 0.91 | 4.2 | A | |
| | B9 | A2 | 0.88 | 5.6 | A | |
| | B10 | A3 | 0.79 | 13.4 | A | |
| | B11 | A4 | 0.94 | 8.8 | B | |
| | B12 | A5 | 0.93 | 5.5 | A | |
| | B13 | A9 | 0.80 | 2.9 | B | |
| | B14 | A10 | 0.91 | 16.5 | B | |
| | B15 | A11 | 0.75 | 7.4 | AA | |
| | B16 | A14 | 0.89 | 10.1 | A | |
| | B17 | A15 | 0.90 | 18.7 | AA | |
| | B18 | A16 | 0.85 | 2.4 | B | |
| | B19 | A19 | 0.88 | 5.5 | AA | |
| | B20 | A24 | 0.90 | 16.2 | A | |
| | B21 | A21 | 0.84 | 13.0 | A | |
| | B22 | A23 | 0.92 | 18.5 | A | |
| | B23 | A20 | 0.78 | 6.0 | A | |
| | B24 | A22 | 0.89 | 3.3 | B | |
| Comp. ex. | b1 | a4 | 0.75 | 1.2 | C | |
| | b2 | a3 | 0.56 | 2.4 | C | |
| | b3 | a6 | 0.45 | 1.4 | D | |
| | b4 | a2 | 0.53 | 1.2 | D | |

TABLE 2-continued

| Notation | Steel no. | Number ratio of long axis 1 μm or more composite oxides (A) and composite oxides (B) (Number of B/Number of A) | Number density of long axis 2 to 15 μm composite oxides among long axis 1 μm or more composite oxides (B) (/mm$^2$) | Evaluation of properties: ridging resistance | Remarks |
|---|---|---|---|---|---|
| b5 | a5 | — | — | — | Production suspended due to nozzle clogging caused by high Ti and large amount of formation of TiN |
| b6 | a1 | 0.61 | 26.7 | C | |

INDUSTRIAL APPLICABILITY

The steel according to the present invention can be utilized for vehicles, household electrical appliance products, and other sorts of industrial products. In particular, it may be used for industrial products with high degree of aesthetic appeal.

The invention claimed is:

1. Ferritic stainless steel with excellent ridging resistance having a composition comprising, by mass %, C: 0.001 to 0.010%,
Si: 0.30% or less,
Mn: 0.30% or less,
P: 0.040% or less,
S: 0.0100% or less,
Cr: 10.0 to 21.0%,
Al: 0.010 to 0.200%,
Ti: 0.015 to 0.300%,
O: 0.0005 to 0.0050%,
N: 0.001 to 0.020%,
Ca: 0.0015% or less, and
Mg: 0.0003% to 0.0030% and
having a balance of Fe and impurities, wherein a number ratio of a number of complex inclusions (B) to a number of complex inclusions (A) satisfies Formula 4, wherein:

complex inclusions (A) are defined as complex inclusions including oxides, and having a long axis of 1 μm or more, and complex inclusions (B) are defined as complex inclusions (A) which further satisfy Formula 1, Formula 2, and Formula 3, wherein a number density of complex inclusions (B) having a long axis of 2 μm or more and 15 μm or less is 2/mm$^2$ or more and 20/mm$^2$ or less; and wherein:

$$Al_2O_3/MgO \leq 4; \quad \text{Formula 1:}$$

$$CaO \leq 20\%; \quad \text{Formula 2:}$$

$$Al_2O_3 + MgO \geq 75\%; \text{ and} \quad \text{Formula 3:}$$

$$\text{Number of complex inclusions } (B)/\text{Number of complex inclusions } (A) \geq 0.70; \quad \text{Formula 4:}$$

where, in Formula 1, Formula 2, and Formula 3, $Al_2O_3$, MgO, and CaO indicate the respective mass % of each component in the oxides.

2. Ferritic stainless steel with excellent ridging resistance according to claim 1, further containing, by mass %, one or more of B: 0.0020% or less,
Nb: 0.60% or less,
Mo: 2.0% or less,
Ni: 2.0% or less,
Cu: 2.0% or less,
Sn: 0.50% or less
V: 0.200% or less,
Sb: 0.30% or less,
W: 1.00% or less,
Co: 1.00% or less,
Zr: 0.0050% or less,
REM: 0.0100% or less,
Ta: 0.10% or less, and
Ga: 0.0100% or less.

3. Ferritic stainless steel with excellent ridging resistance according to claim 2, wherein said complex inclusions (A) contain TiN and said chemical composition satisfies Formula 5; and wherein:

$$2.44 \times [\%\ Ti] \times [\%\ N] \times \{[\%\ Si] + 0.05 \times ([\%\ Al] - [\%\ Mo]) - 0.01 \times [\%\ Cr] + 0.35\} \geq 0.0008 \quad \text{Formula 5:}$$

where, [% Ti], [% N], [% Si], [% Al], [% Mo], and [% Cr] show the mass % of the respective elements in the steel.

4. Ferritic stainless steel with excellent ridging resistance according to claim 3, wherein said chemical composition satisfies Formula 6; and wherein:

$$250 \times [\%\ C] + 2 \times [\%\ Si] + [\%\ Mn] + 50 \times [\%\ P] + 50 \times [\%\ S] + 0.06 \times [\%\ Cr] + 60 \times [\%\ Ti] + 54 \times [\%\ Nb] + 100 \times [\%\ N] + 13 \times [\%\ Cu] \geq 36 \quad \text{Formula 6:}$$

where, [% C], [% Si], [% Mn], [% P], [% S], [% Cr], [% Ti], [% Nb], [% N], and [% Cu] show the mass % of the respective elements in the steel; when not contained, 0 is entered.

5. Ferritic stainless steel with excellent ridging resistance according to claim 2, wherein said chemical composition satisfies Formula 6; and wherein:

$$250 \times [\%\ C] + 2 \times [\%\ Si] + [\%\ Mn] + 50 \times [\%\ P] + 50 \times [\%\ S] + 0.06 \times [\%\ Cr] + 60 \times [\%\ Ti] + 54 \times [\%\ Nb] + 100 \times [\%\ N] + 13 \times [\%\ Cu] \geq 36 \quad \text{Formula 6:}$$

where, [% C], [% Si], [% Mn], [% P], [% S], [% Cr], [% Ti], [% Nb], [% N], and [% Cu] show the mass % of the respective elements in the steel; when not contained, 0 is entered.

6. Ferritic stainless steel with excellent ridging resistance according to claim 1, wherein said complex inclusions (A) contain TiN and said chemical composition satisfies Formula 5; and wherein:

$$2.44\times[\%\ Ti]\times[\%\ N]\times\{[\%\ Si]+0.05\times([\%\ Al]-[\%\ Mo])-0.01\times[\%\ Cr]+0.35\}\geq 0.0008 \quad \text{Formula 5:}$$

where, [% Ti], [% N], [% Si], [% Al], [% Mo], and [% Cr] show the mass % of the respective elements in the steel.

7. Ferritic stainless steel with excellent ridging resistance according to claim 6, wherein said chemical composition satisfies Formula 6; and wherein:

$$250\times[\%\ C]+2\times[\%\ Si]+[\%\ Mn]+50\times[\%\ P]+50\times[\%\ S]+0.06\times[\%\ Cr]+60\times[\%\ Ti]+54\times[\%\ Nb]+100\times[\%\ N]+13\times[\%\ Cu]\geq 36 \quad \text{Formula 6:}$$

where, [% C], [% Si], [% Mn], [% P], [% S], [% Cr], [% Ti], [% Nb], [% N], and [% Cu] show the mass % of the respective elements in the steel; when not contained, 0 is entered.

8. Ferritic stainless steel with excellent ridging resistance according to claim 1, wherein said chemical composition satisfies Formula 6; and wherein:

$$250\times[\%\ C]+2\times[\%\ Si]+[\%\ Mn]+50\times[\%\ P]+50\times[\%\ S]+0.06\times[\%\ Cr]+60\times[\%\ Ti]+54\times[\%\ Nb]+100\times[\%\ N]+13\times[\%\ Cu]\geq 36 \quad \text{Formula 6:}$$

where, [% C], [% Si], [% Mn], [% P], [% S], [% Cr], [% Ti], [% Nb], [% N], and [% Cu] show the mass % of the respective elements in the steel; when not contained, 0 is entered.

* * * * *